US006096143A

United States Patent [19]

Rückert et al.

[11] Patent Number: 6,096,143

[45] Date of Patent: Aug. 1, 2000

[54] CYLINDER LINER OF A HYPEREUTECTIC ALUMINUM/SILICON ALLOY FOR USE IN A CRANKCASE OF A RECIPROCATING PISTON ENGINE AND PROCESS FOR PRODUCING SUCH A CYLINDER LINER

[75] Inventors: Franz Rückert, Ostfildern; Peter Stocker, Sulzbach/Murr; Roland Biedermann, Stuttgart; Roland Rieger, Weinstadt, all of Germany

[73] Assignee: DaimlerChrysler AG, Stuttgart, Germany

[21] Appl. No.: 08/967,944

[22] Filed: Nov. 12, 1997

Related U.S. Application Data

[63] Continuation-in-part of application No. 08/544,978, Oct. 30, 1995, abandoned, and a continuation-in-part of application No. 08/671,367, Jun. 28, 1995, abandoned.

[30] Foreign Application Priority Data

Oct. 28, 1994 [DE] Germany ..... 44 38 550
Jun. 28, 1995 [DE] Germany ..... 195 23 484

[51] Int. Cl.[7] ..... C22C 21/16

[52] U.S. Cl. ..... 148/439; 428/650

[58] Field of Search ..... 148/440, 439; 428/650

[56] References Cited

U.S. PATENT DOCUMENTS

| | | | |
|---|---|---|---|
| 4,099,314 | 7/1978 | Perrot et al. | 29/420 |
| 5,253,625 | 10/1993 | Donahue et al. | 123/193.4 |
| 5,387,272 | 2/1995 | Kamitsuma et al. | 75/236 |

FOREIGN PATENT DOCUMENTS

| | | |
|---|---|---|
| 0 508 426 | 10/1992 | European Pat. Off. . |
| 72 42 072 | 8/1973 | France . |
| 2 343 895 | 10/1977 | France . |
| 24 08 276 | 8/1975 | Germany . |
| 60-228645 | 11/1985 | Japan . |
| 62-10237 | 1/1987 | Japan . |
| 2-104465 | 4/1990 | Japan . |
| 3-113173 | 5/1991 | Japan . |
| 5-179387 | 7/1993 | Japan . |
| 6-167242 | 6/1994 | Japan . |
| 1109084 | 1/1968 | United Kingdom . |

*Primary Examiner*—Sikyin Ip
*Attorney, Agent, or Firm*—Evenson, McKeown, Edwards & Lenahan, P.L.L.C.

[57] ABSTRACT

A cylinder liner cast into a reciprocating piston engine made of a supereutectic aluminum/silicon alloy which is free of mixed-in particles of hard material and which is composed in such a way that fine silicon primary crystals and intermetallic particles automatically form from the melt as hard particles. A blank is allowed to grow from finely sprayed melt droplets by spray compaction, with a fine distribution of hard particles being produced by setting the spray for small melt droplets. The blank can then be formed by cold extrusion to create a shape approximating the cylinder lining. After premachining, the surface is fine machined, honed in at least one stage and then the hard particles lying at the surface are mechanically or chemically exposed, forming plateau areas of hard particles which project above the remaining surface of the base microstructure of the alloy. The mechanical exposure of the primary crystals or particles is carried out by a honing process using felt strips which are cylindrically shaped on the outside and a slurry of SiC particles in honing oil. The chemical exposure of the primary crystals or particles is carried out by using aqueous alkali. The fine-grained, hard particles formed from the melt and also the mechanical exposure of the hard particles on the surface of the cylinder results not only in high wear resistance and high contact area of the surface, but also in gentle treatment of the piston and its rings.

13 Claims, 6 Drawing Sheets

CYLINDER LINER OF A HYPEREUTECTIC ALUMINUM/SILICON ALLOY FOR USE IN A CRANKCASE OF A RECIPROCATING PISTON ENGINE AND PROCESS FOR PRODUCING SUCH A CYLINDER LINER

CROSS-REFERENCE TO RELATED APPLICATIONS

This application is a continuation-in-part of abandoned application Ser. No. 08/544,978, filed Oct. 30, 1995, and is a continuation-in-part of abandoned application Ser. No. 08/671,367, filed Jun. 28, 1995.

This application claims the priority of German application No. P 44 38 550.1, filed Oct. 28, 1994, and German application No. 19523484.7, filed Jun. 28, 1995, the disclosures of which are expressly incorporated by reference herein.

BACKGROUND OF THE INVENTION

This invention relates to a cylinder liner of a hypereutectic aluminum/silicon alloy for use into a reciprocating piston engine and a process for producing such a cylinder liner. More particularly, this invention relates to embodiments of a cylinder liner of a hypereutectic aluminum/silicon alloy for casting into a reciprocating piston engine, and processes for producing such a cylinder liner.

Hagiwara EP 367,229 A1 discloses a cylinder liner which is produced from metal powder, such as aluminum oxide, with from 0.5 to 3% graphite particles mixed-in, which have a particle diameter of at most 10 $\mu$m or less (measured in a plane perpendicular to the cylinder axis) and from 3 to 5% hard material particles without sharp edges, which have a particle diameter of at most 30 $\mu$m and on an average 10 $\mu$m or less. The metal powder is produced first, without mixing-in the nonmetallic particles, by air atomization of a supereutectic (the terms "hypereutectic" and "supereutectic" are used interchangeably herein) aluminum/silicon alloy having the following composition, with the remainder being aluminum (figures are in % weight based on the total metal content of the alloy, i.e. without the particles of hard material and graphite):

| | |
|---|---|
| Silicon | 16 to 18% |
| Iron | 4 to 6%, |
| Copper | 2 to 4%, |
| Magnesium | 0.5 to 2% and |
| Manganese | 0.1 to 0.8%. |

The metal powder is mixed with non-metallic particles and this powder mixture is pressed at about 2,000 bar to give a preferably tubular body. This powder metallurgically produced blank is inserted into a soft-aluminum tube, aluminum tube of corresponding shape to make a double layer tube, which is jointly sintered and shaped in an extrusion process, preferably at elevated temperatures, to give a tubular blank from which the individual cylinder liners can be produced. The embedded particles of hard material are intended to give the cylinder liner good wear resistance, while the graphite particles serve as a dry lubricant. However, to avoid oxidation of the graphite particles, the hot extrusion should take place in the absence of oxygen. There is also the danger of the graphite reacting with the silicon at high processing temperatures and forming hard SiC on the surface, which interferes with the dry-lubricating properties of the embedded graphite particles. Furthermore, local surface fluctuations in the concentration of particles of hard material and/or graphite can never be entirely eliminated.

Due to the embedded hard material particles, the hot-pressing mould wears out relatively rapidly, since the hard material particles still have, in spite of their rounded edges, a powerfully abrasive action; with reasonable effort, it is in any case possible only to round the edges partially on the particles formed by crushing comminution. The subsequent mechanical treatment of the running surface of the cylinder liner also entails high tool wear and thus high tool costs. The hard material particles exposed in the running surface have sharp edged boundaries after the surface machining and subject the piston skirt and the piston rings to relatively extensive wear, so that these must be produced from a wear-resistant material and/or must be provided with an appropriately wear-resistant coating. The known cylinder liner altogether is not only relatively expensive due to the starting materials with several separate components, but the high tool costs in connection with the plastic and metal-removing machining greatly increase the cost per piece. Apart from this, the type of manufacture of the known cylinder liner from a heterogeneous powder mixture involves the risk of inhomogeneities which, under some circumstances, cause a functional impairment, that is to say rejects, but in any case require expensive quality monitoring. Furthermore, it presupposes piston designs which are complex in engine operation and which altogether make the reciprocating piston engine more expensive.

Other disadvantages of Hagiwara, et al. '229, are due to the fact that the embedded particles of hard material, despite their rounded edges, still have strong abrasive action, thereby causing the hot pressing die to wear out relatively quickly. In any case, only a partial rounding of the particle edges formed by crushing can be achieved with justifiable effort. High tool wear, and thus high tool costs, is also associated with the subsequent machining of the surface of the cylinder liner. After machining, the hard material particles exposed on the surface, have sharp edges and cause relatively high wear of the piston and the piston rings, therefore, these have to be made of wear-resistant material or be provided with appropriate wear resistant coating.

Basically, the Hagiwara, et al. '229 cylinder liner is not only relatively expensive because the starting materials require several separate components, but also because of the high tool costs associated with the process. Additionally, because these known cylinder liners are produced from a heterogeneous powder mixture, the danger of inhomogeneities exists, which may result in impaired function, and thus in rejects, requiring careful quality control. In addition, for use in an engine, complicated piston construction is required, which makes the entire reciprocating piston engine more expensive.

Kiyota, et al., U.S. Pat. No. 4,938,810, likewise discloses a powder-metallurgically produced cylinder liner. In this patent, a large number of alloy examples are listed, and measurement data and operating data of the cylinder liners produced with these are also given. The silicon content of the examples provided are in the range of from 10 to 30%, which extends into the subeutectic region, and preferably from 17.2 to 23.6%. At least one of the metals, nickel, iron or manganese, should be present in the alloy, in an amount of at least 5% or, in the case of iron in an amount of at least 3%.

An example of an alloy composition of Kiyota, et al. '810 in % by weight, where the remainder is aluminum, and the content of zinc and manganese are not specified, and are therefore assumed to be present in trace quantities only, follows:

| | |
|---|---|
| Silicon: | 22.8%, |
| Copper: | 3.1%, |
| Magnesium: | 1.3%, |
| Iron: | 0.5% and |
| Nickel: | 8.0%. |

the remainder being aluminum.

The nickel content in the alloy example given is very high. A blank for a cylinder liner is hot-extruded from the powder mixture.

Perrot, et al., U.S. Pat. No. 4,155,756, deals with the same topic. In this case, inter alia, the following composition of a powder-metallurgically produced cylinder liner is given as one example of several:

| | |
|---|---|
| Silicon: | 25%, |
| Copper: | 4.3%, |
| Magnesium: | 0.65% and |
| Iron: | 0.8%. |

the remainder being aluminum.

SUMMARY OF THE INVENTION

It is the primary object of the present invention to improve cylinder liners by increasing wear resistance.

It is another object of the present invention to improve cylinder liners by increasing wear resistance, thereby reducing the danger of wear on the piston, and decreasing the amount of lubricating oil necessary.

The main interest in reducing the amount of lubricating oil necessary does not so much concern the lubricating oil itself, but rather its combustion residues, essentially hydrocarbons, which pollute the exhaust gas emitted from internal combustion engines.

This object is achieved according to a first embodiment of the present invention by a cylinder liner which is sealed into a reciprocating piston engine, comprising a supereutectic aluminum/silicon alloy and a method of producing such a cylinder liner, in which the surface of the cylinder is first roughly machined, then fine machined by boring or turning, and subsequently honed in at least one stage. As a result, the surface particles which are harder than the base microstructure of the alloy, such as silicon crystals and/or intermetallic phases, are exposed in level areas projecting above the remaining surface of the base microstructure of the alloy.

The specific alloy composition of the material used for the cylinder liner allows silicon primary crystals and intermetallic phases to be formed directly from the melt, therefore, there is no need to separately mix-in hard particles. Furthermore, spray compaction of the alloy, a known process which can be readily mastered and is comparatively inexpensive, is used together with subsequent, energy-saving cold extrusion of the blank. This method results in particularly low oxidation of the droplet surfaces and particularly low porosity of the liner. The alloy compositions A and B mentioned below are for use respectively with iron-coated pistons and with uncoated aluminum pistons.

The hard particles formed from the melt have a high hardness and give the surface good wear resistance without seriously impeding the machining of the material, so that the surface is sufficiently readily machinable. Furthermore, because of the formation of the primary crystals and intermetallic phases in each melt droplet sprayed onto and subsequently solidifying on the blank, the process results in a very uniform distribution of hard particles on the workpiece. The particles formed from the melt are also less angular and tribologically less aggressive than crushed particles. Moreover, hard metallic particles formed from the melt are more intimately embedded in the basic alloy microstructure than are nonmetallic crushed particles which have been mixed in. This factor lowers the danger of crack formation at the boundaries of the hard particles. In addition, the hard particles formed from the melt display better breaking-in behavior and lower abrasive aggressivity towards the piston and its rings, so that longer lifetimes result or, in any case, so that less complex piston designs are possible.

This object is achieved according to a second embodiment of the invention by providing a cylinder liner of a hypereutectic aluminum/silicon alloy cast into a reciprocating piston engine, the cylinder liner having the following features:

the aluminum/silicon alloy, free of hard material particles independent of the melt, of the cylinder liner (6) (see FIG. 1) is made of either Alloy A or Alloy B, the numerical data denoting the content in percent by weight:

| Alloy A: | |
|---|---|
| Silicon | 23.0 to 28.0%, preferably about 25%, |
| Magnesium | 0.80 to 2.0%, preferably about 1.2%, |
| Copper | 3.0 to 4.5%, preferably about 3.9%, |
| Iron | at most 0.25%, |
| Manganese, nickel and zinc each at most 0.01%, the remainder being aluminum. | |

| Alloy B: | |
|---|---|
| Silicon | 23.0 to 28.0%, preferably about 25%, |
| Magnesium | 0.80 to 2.0%, preferably about 1.2%, |
| Copper | 3.0 to 4.5%, preferably about 3.9%, |
| Iron | 1.0 to 1.4%, |
| Nickel | 1.0 to 5.0%, |

Manganese and zinc each at most 0.01%, the remainder being aluminum, the cylinder liner (6) contains primary silicon crystals (8) and intermetallic phases (9, 10) having the following grain sizes, the numerical data denoting the mean grain diameter in $\mu$m:

Primary Si crystals: 2 to 15, preferably 4.0 to 10.0 $\mu$m, $Al_2Cu$ phase: 0.1 to 5.0, preferably 0.8 to 1.8 $\mu$m, $Mg_2Si$ phases: 2.0 to 10.0, preferably 2.5 to 4.5 $\mu$m, primary silicon crystals (8) and particles of intermetallic phases (9, 10) embedded in the surface are exposed out of the precision-machined running surface (7) of the cylinder liner (6).

In another aspect, the present invention includes a process for producing a cylinder liner of a hypereutectic aluminum/silicon alloy, in which the cylinder liner is initially produced on its own as a tubular semi-finished product made of the alloy and then cast into a crankcase of a reciprocating piston engine. Moreover, in the cast-in state of the cylinder liner, the running surface thereof is coarsely premachined with chip removal and then precision-machined by a kind of drilling or turning and subsequently honed in at least one stage. The particles lying in the running surface and turning out harder than the matrix structure of the alloy, such as silicon crystals and intermetallic phases, are then exposed in such a way that plateau faces of the particles protrude from the remaining surface of the matrix structure of the alloy. The exposing of the embedded primary crystals (8) and/or particles (9, 10) out of the running surface (7) of the cylinder liner (6) which has been cast into the crankcase and has already been precision-machined on its running surface (7), is effected chemically by etching with alkali.

A hollow blank with fine-grained formation of the primary silicon crystals (8) and intermetallic phases (9, 10) therein is first produced from the aluminum/silicon alloy by fine atomization of the melt and precipitation of the melt mist to give a growing body and the hollow blank is transformed by extrusion to give a tubular semi-finished product from which the cylinder linear is produced. During spraying, the melt is atomized so finely that the primary silicon crystals (8) and intermetallic phases (9, 10) forming in the growing hollow blank arise in grain sizes having the following dimensions, the numerical data denoting the mean grain diameter in $\mu$m:

Primary Si crystals: 2 to 15, preferably 4.0 to 10.0 $\mu$m,
$Al_2Cu$ phase: 0.1 to 5.0, preferably 0.8 to 1.8 $\mu$m,
$Mg_2Si$ phase: 2.0 to 10.0, preferably 2.5 to 4.5 $\mu$m.

Due to the special alloy composition of the material for the cylinder liner, primary silicon crystals and intermetallic phases form directly from the melt; admixing of separate hard particles is therefore unnecessary. Moreover, the spray-compacting of the alloy, which is readily controllable by process engineering and comparatively inexpensive, with subsequent extrusion of the blank is employed. Swaging and so-called thixoforming are also possible. These processes, in particular extrusion, lead to particularly low oxidation of the droplet surfaces and to a particularly low porosity of the liner. The abovementioned alloy compositions A and B respectively have been optimized with a view to an actual use with iron-coated pistons (alloy A) and with uncoated aluminum pistons (alloy B). The hard particles formed in the melt have, on the one hand, a high hardness and confer good wear resistance upon the running surface and, on the other hand, these hard particles formed in the melt do not unduly impair the machining of the material, so that the running surface can be fairly readily mechanically worked. Due to the formation of the primary crystals and intermetallic phases in each individual melt droplet, sprayed and then solidified on the growing blank, a very uniform distribution of the hard articles results in the workpiece, as the outcome of the process. The particles formed in the melt are, moreover, less angular and are tribologically not as aggressive as broken particles. Moreover, the metallic hard particles formed in the melt are more intimately embedded in the alloy matrix structure as compared with non-metallic broken particles which have been mixed in, so that there is less risk of cracking at the boundaries of hard material. Furthermore, the hard particles formed in the melt show better running-in behavior and lower abrasive aggressivity towards the piston and its rings, so that longer service lives result or—conventional service lives are accepted—less complex designs for the pistons and/or piston rings can be permitted.

In a preferred embodiment, the depth (t) of exposing of the plateau faces (11) of the primary crystals (8) and/or the phases (9, 10) relative to the surrounding alloy (12) is about 0.3 to 1.2 $\mu$m, preferably about 0.7 $\mu$m.

After the primary crystals (8) and/or phases (9, 10) have been exposed, the running surface (7) of the cylinder liner (6) has a roughness with the following values:

| | |
|---|---|
| average peak-to-valley height | $R_z$ = 2.0 to 5.0 $\mu$m, |
| maximum individual peak-to-valley height | $R_{max}$ = 5 $\mu$m, |
| core peak-to-valley height | $R_k$ = 0.5 to 2.5 $\mu$m, |
| reduced peak height | $R_{pk}$ = 0.1 to 0.5 $\mu$m, and |
| reduced groove depth | $R_{vk}$ = 0.3 to 0.8 $\mu$m, |

the terms and values $R_z$ and $R_{max}$ having to be understood and determined in accordance with DIN 4768, sheet 1, and the terms and values $R_k$, $R_{pk}$ and $R_{vk}$ having to be understood and determined in accordance with DIN 4776.

BRIEF DESCRIPTION OF THE DRAWINGS

Other objects, advantages and applications of this invention will be made apparent by the following detailed description. The description makes reference to a preferred and illustrative embodiment of the invention presented in the accompanying drawings wherein.

DETAILED DESCRIPTION OF THE PREFERRED EMBODIMENTS

Figure 1:
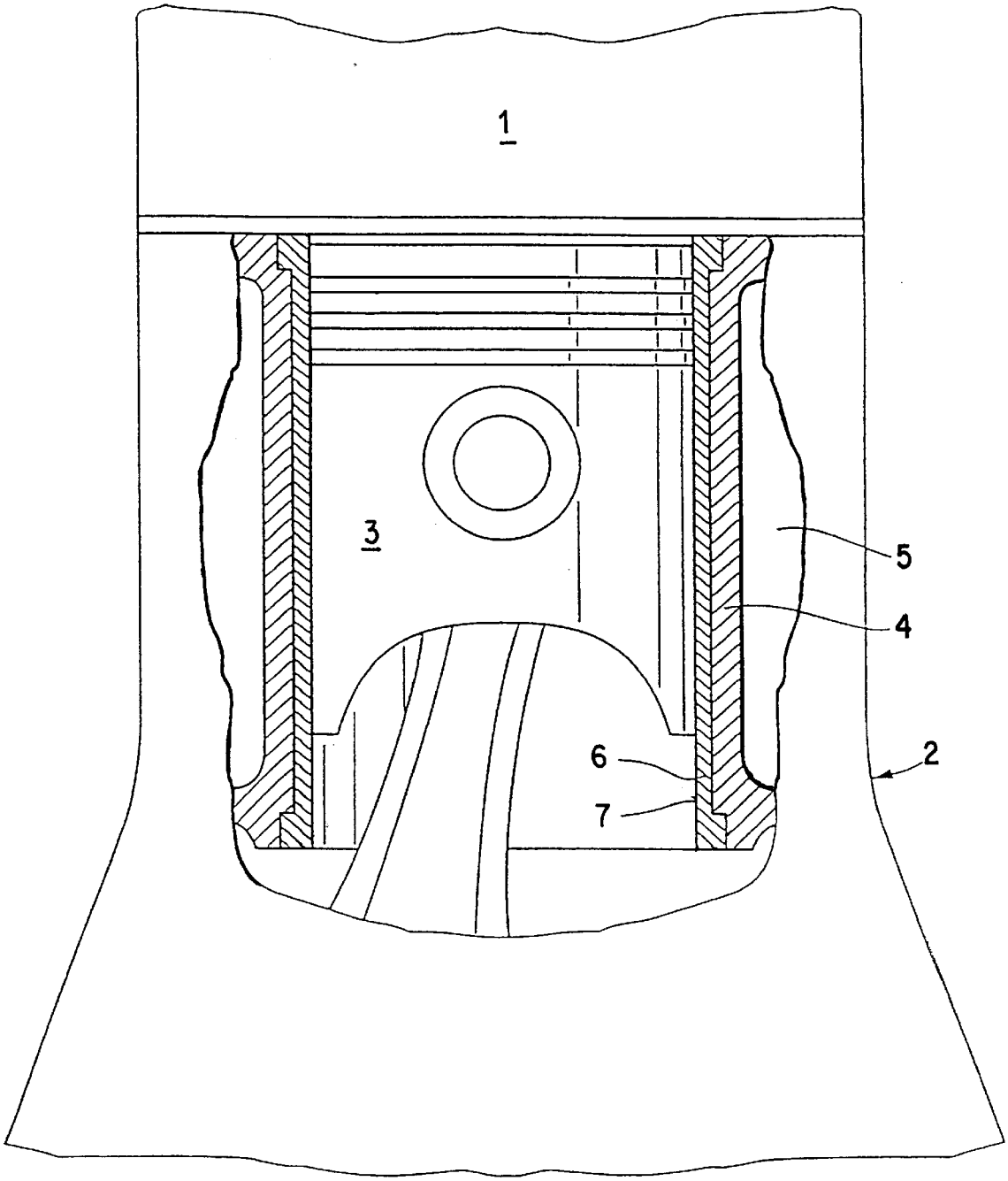
FIG. 1 is an elevational view, partly in cross-section of a reciprocating piston engine with a cast-in cylinder liner according to the invention.

The reciprocating piston engine shown in FIG. 1 comprises a die cast crankcase 2 in which the cylinder wall 4 is arranged to accommodate a cylinder liner 6 in which a piston 3 is installed so as to be able to move up and down. A cylinder head 1, which is attached on top of the crankcase 2, is fitted with devices for charge change and charge ignition. Within the crankcase 2, a hollow space for forming a water jacket 5 around the cylinder wall 4 is provided for cylinder cooling.

The cylinder liner 6 is made as a separate part by the method described in detail below, of a supereutectic composition further described below, and is then cast as a blank part into the crankcase 2 and machined together with the crankcase. For this purpose, inter alia, the face of the cylinder liner 7 is first roughly premachined and subsequently fine machined by boring or turning. The face 7 is subsequently honed in at least one stage. After honing, the particles lying on the surface which are harder than the base microstructure of the alloy, such as silicon crystals and intermetallic phases, are exposed in such a way that level areas of the particles project above the remaining surface of the base microstructure of the alloy.

The present invention claims a cylinder liner which is improved with respect to increasing wear resistance and decreasing the consumption of lubricating oil, and thereby decreasing the emission of hydrocarbons by an internal combustion engine, and a method of making the cylinder liner.

First, it should be mentioned that two alternative types of preferred alloys have been found, with one alloy, type A, recommended for use together with iron-coated pistons and the other alloy, type B, recommended for use with uncoated aluminum pistons. Alloy A has the following composition, the percentages are by weight:

Silicon from 23.0 to 28.0%, preferably about 25%,
Magnesium from 0.80 to 2.0%, preferably about 1.2%,
Copper from 3.0 to 4.5%, preferably about 3.9%,
Iron max. O.25%
Manganese, nickel and zinc max. of each 0.01% and the remainder aluminum.

Alloy B, for use with uncoated aluminum pistons, has the same composition as alloy A with respect to the proportions of silicon, magnesium, copper, manganese and zinc, with the content of iron and rickel being somewhat higher, namely:
Iron from 1.0 to 1.4%
Nickel from 1.0 to 5.0% and the remainder aluminum.

A melt of the aluminum/silicon alloy is finely sprayed in an oxygen-frees atmosphere and the atomized melt is deposited to create a growing body, first producing a hollow blank containing fine-grained silicon primary crystals 8 and intermetallic phases 9 and 10, with the intermetallic phases containing magnesium and silicon ($Mg_2Si$) and aluminum and copper ($Al_2Cu$). The atomized melt is very quickly cooled in a jet of nitrogen, with cooling rates in the range of $10^3$–$10^5$ K/sec.

The remainder of the melt droplets remain liquid until impinging on the hollow-blank carrier, or at least only partially solidify. This so-called spray compacting produces a microstructure having a very narrow grain size distribution with a range of about ±5 to 10 μm from a mean value, with the mean value being adjusted within a relatively wide particle size range, from about 7 to about 200 μm preferably between about 30 and about 50 μm. A very fine grain setting is used, with a particle size of from 2 to 10 μm, so that a correspondingly fine microstructure having a fine and uniform silicon distribution is formed.

Each powder particle contains all the alloy constituents. The powder particles or droplets are sprayed onto a rotating disc on which the hollow blank mentioned above grows with a diameter of, for example, 250, 300, 400, or 1000 mm, depending on the design of the apparatus. Subsequently, the blanks have to be extruded on an extruder, according to known methods, to form tubes. In a variation, the blank is not allowed to grow axially on a rotating disc, but the atomized melt is allowed to grow radially on a rotating cylinder, so that an essentially tubular intermediate is formed.

Figure 2:
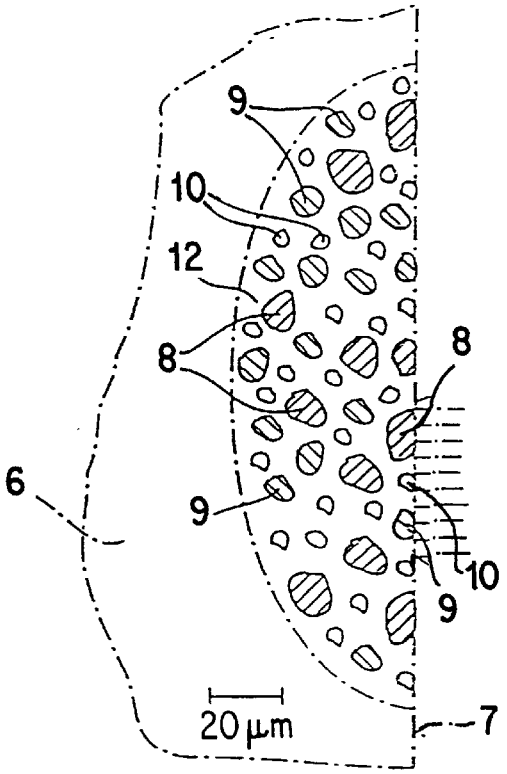
FIG. 2 is a magnified portion of a cross-section of the cylinder liner made by the method of the first embodiment close to the surface, taken parallel to the cylinder wall.
Figure 2A:
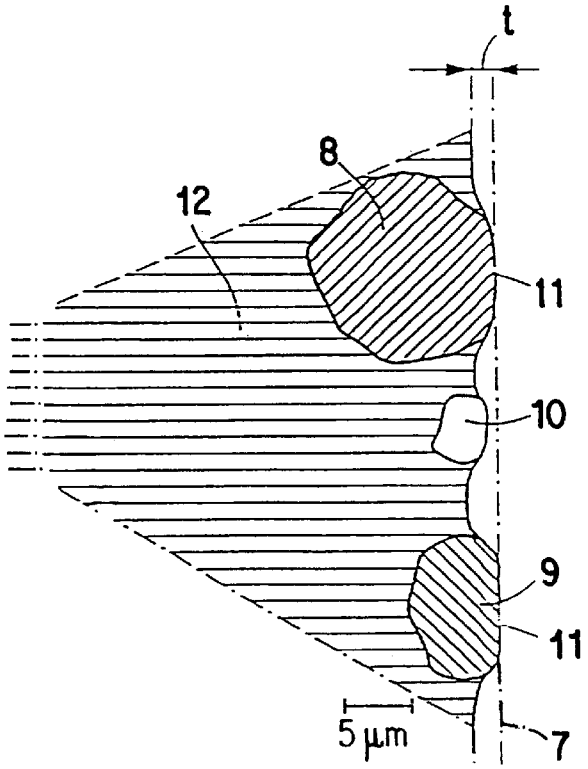
FIG. 2*a* is a further enlargement of FIG. 2.
Figure 3:
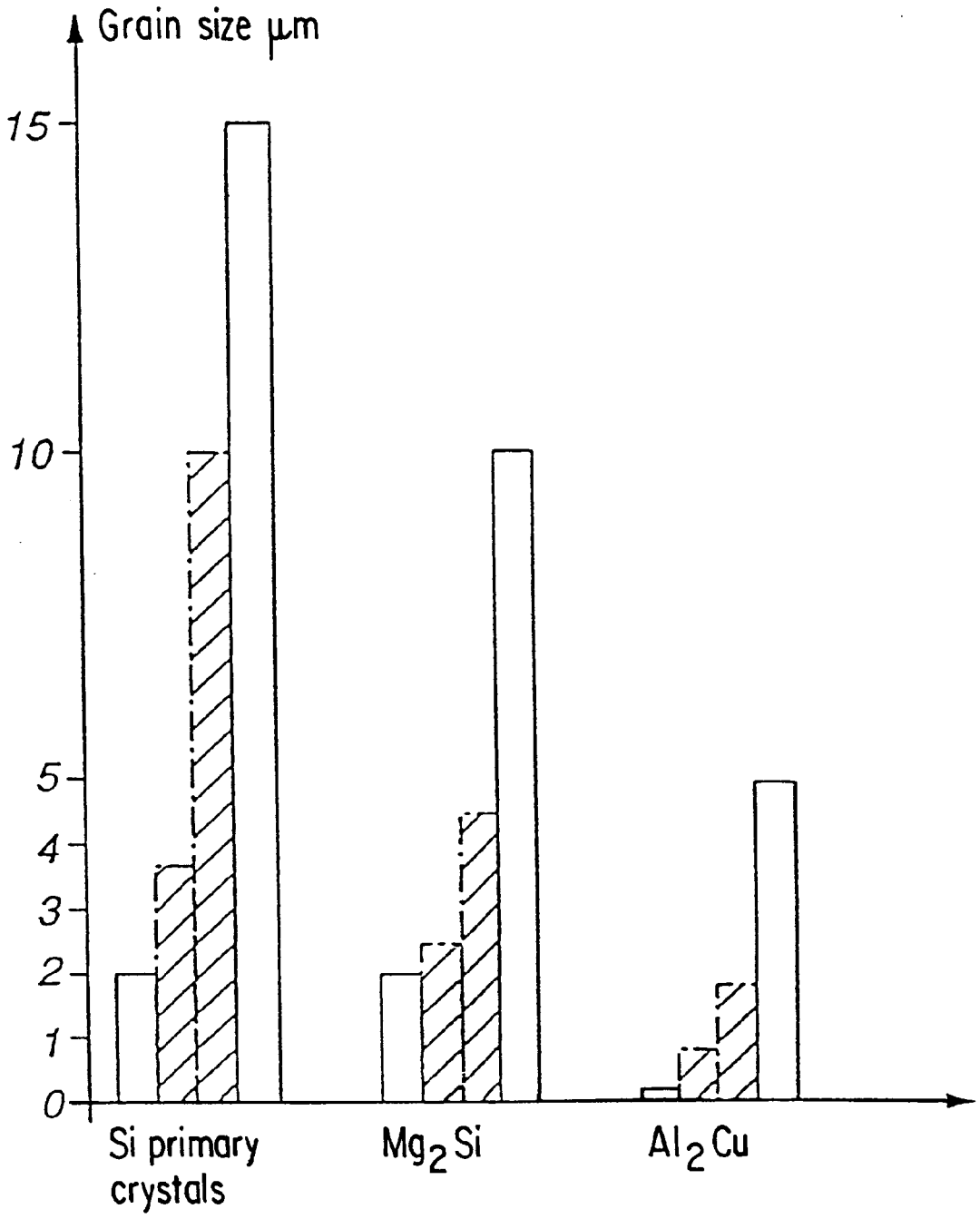
FIG. 3 is a bar diagram which illustrates the grain sizes of the various hard particles formed in the melt.

During spraying, the melt is so finely atomized that the primary silicon crystals 8 and the intermetallic phases or particles 9 and 10, seen in FIGS. 2 and 2*a,* which form in the growing hollow blank have very small grain sizes as follows:

| | |
|---|---|
| Si primary crystals: | from 2 to 15 μm, preferably from 4 to 10 μm, |
| $Al_2Cu$ phase: | from 0.1 to 5.0 μm, preferably from 0.8 to 1.8 μm, |
| $Mg_2Si$ phase: | from 2.0 to 10.0 μm, preferably from 2.5 to 4.5 μm. |

The fines grained nature of the spray creates a finely dispersed distribution of hard particles within the base microstructure of the alloy and a homogeneous material is obtained. The fine grained nature of the spray creates a finely dispersed distribution of hard particles within the base microstructure of the alloy and a homogeneous material is obtained. Since a single melt is atomized, no inhomogeneities due to mixing are formed. Additionally, because the atomized melt droplets are compacted, a very intimate bonding between the droplets results, which in turn results in a substantially low porosity.

The blanks of the cylinder liner produced by this process, with possible further machining, are sealed into a crankcase comprising a readily castable aluminum alloy, preferably produced using a pressure die casting process. For this purpose, the prefabricated cylinder liners are pushed onto a guide pin with the die casting mold open. The mold is then closed and the die casting material is injected. According to this method, there is no danger of the cylinder liner material being thermally affected in an uncontrolled way by the die cast melt because of the rapid cooling time and the ability to cool the cylinder liner via the guide pin. Furthermore, the alloy used for die casting is subeutectic and therefore readily processable by casting. The thermal expansion of the alloy of the diecasting workpiece on the one hand and the cylinder liner on the other are only slightly distinguishable in order to avoid uncontrolled heat strains between the two of them. The material used in conjunction with the diecasting workpiece thereby exhibits a slightly higher expansion coefficient than the cylinder liner, which guarantees a proper force fit between the two of them.

After the cylinder liner has been cast into the crankcase, the cylinder is machined on the appropriate surfaces, particularly on the face 7 of the cylinder liner 6. This machining process, for example boring and honing as mentioned here, are known-processes. Subsequently, the silicon primary crystals 8 and the particles of intermetallic phases 9 and/or 10 embedded in the surface must be exposed.

In the first embodiment of the present invention, this exposure is accomplished by mechanical means. The primary crystals 8 and intermetallic particles 9 and 10 embedded in the surface are mechanically exposed by a grinding or polishing process using compliant, shaped polishing or grinding bodies 16, FIG. 4. This avoids not only the disadvantages and costs of etching, but also gives particular advantages for the face 7 of the cylinder liner, as detailed below. The cost per cylinder liner incurred by the mechanical exposure of the present invention are lower than the costs of a honing process.

Figure 4:
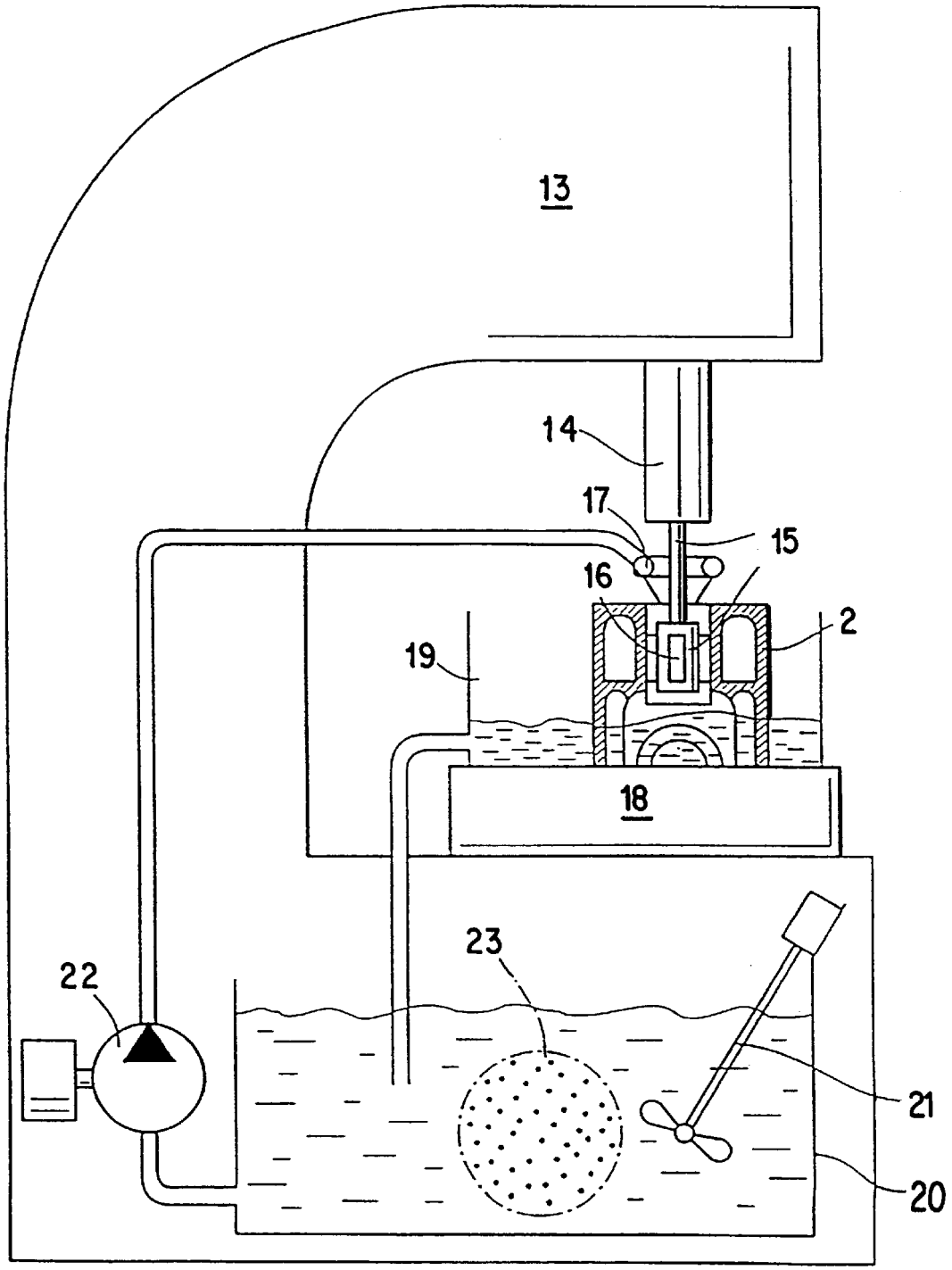
FIG. 4 shows a modified honing machine for mechanically exposing the hard particles from the surface of the cylinder liner.

FIG. 4 represents a honing machine usable in connection with the mechanical exposure described above. FIG. 4 represents a honing machine usable in connection with the mechanical exposure described above. The honing machine 13 has a movable machine table 18 on which the crankcase 2 is arranged in a pan 19. Above the machine table 18 at least one vertical honing spindle 14 is arranged into which a honing tool 15 is fitted, which can be lowered into a cylinder bore of the crankcase.

One advantage of the present honing machine is that the honing tool 15 is fitted, not with hard honing stones, but with a plurality of axially orientated felt strips 16 fitted on its circumference which, because felt is soft and compliant, automatically give a cylindrical fit to the inner surface of the cylinder liner. These match the shape of the cylinder and serve as polishing or grinding bodies.

The construction of the honing tool includes metal abrasive carriers which are fitted in the honing tool so as to be radially movable and which can be pressed with adjustable force against the inner surface of the cylinder liner. The metal abrasive carriers are planar, i.e. not cylindrical, on the side facing radially outwards. Flat pieces of a felt mat having a thickness of 9 mm are cut to match the flat surfaces of the metal abrasive carriers and glued onto these flat surfaces. The required cylindrical shape of the felt results automatically when the honing polishing or grinding under pressure of the felt pieces against the inner surface of the cylinder liner is started.

The felt material used is a felt designated as Stückfilz Tm 30 - 9, DIN 61206. The felt designated as Stückfilz Tm 32 - 9, DIN 61206 would certainly also be suitable. The individual designations used to describe the felt have the following meanings:

m→mixed,

30→bulk density of 0.30 g/cm$^3$

32→bulk density of 0.32 g/cm$^3$,

9→9 mm in thickness.

The hardness of the felt pieces was M6 (or medium 6) in accordance with DIN 61200. In the case of Stückfilz Tm 32 5 - 9, DIN 61206, a hardness of F1 (or firm 1) according to DIN 61200 could be recommended.

Since the mechanical exposure according to the present invention is carried out in the presence of an abrasive, amorphous grinding or polishing medium containing particles of hard material, the honing machine 13 has a reservoir 20 for holding a slurry 23 of fine particles of hard material, preferably silicon carbide particles in honing oil, placed in proximity of the honing machine to supply the grinding medium. To avoid sedimentation of the particles of hard material, the reservoir is provided with a stirrer 21. A circulation pump 22 conveys the slurry from the reservoir 20 to an annular sprinkling head 17 which goes around the honing tool above the cylinder liner and supplies plenty of grinding fluid.

During mechanical exposure,

During mechanical exposure, During mechanical exposure, the rotating honing tool oscillates axially up and down so that all parts of the face 7 of the cylinder liner are in contact with the felt strips 16. Furthermore, the honing tool is configured in such a way that the felt strips can be pressed with an adjustable pressure against the face 7, wherein the pressure is from about 3 to 5 bar, preferably about 4 bar. By using this machining method, the material of the base alloy which is located between the individual harder particles at the surface, is removed to some extent, so that the harder particles project above the abraded base material 12 creating a plateau area 11. The measurement t represents the exposure depth.

According to this method, the edges of the plateau areas 11 are rounded so that they form a smooth contact with the base alloy material 12. This particular configuration of the plateau areas 11 has advantageous for the piston or the piston rings that slide over them, because this configuration is not very aggressive tribologically in comparison to the sharp-edged particles of hard material resulting when chemical exposure is used.

The measure of the exposure depth t can, apart from the force pressing the felt strips, be determined primarily by the duration of the mechanical exposure by the honing process. This is due to the fact that, with an increasing time of exposure, the plateau areas 11 are increasingly rounded and abraded into a dome-like shape. It is therefore advantageous to carry out the mechanical exposure process according to the present invention for from about 20 to 60 seconds, preferably about 40 seconds. This will result in an exposure depth of from about 0.2 to 0.3 $\mu$M.

This exposure depth results in a surface roughness which is at least of the same order of magnitude, if not greater, than the exposure depth. The roughness of the surface is essentially determined by the grain size of the particles of hard material in the slurry 23. The roughness values for machined cylinder surfaces are in the range of from 0.7 to 1.0 $\mu$m. These roughness values and the low exposure depth permit very low oil consumption and thus a very low emission of hydrocarbons is achieved. In addition, the wear resistance and the sliding properties of the cylinder liners produced by this method are excellent.

In the second embodiment, the exposing is effected chemically by etching with easily neutralizable fluid agents compatible with the environment, namely, for example, aqueous caustic soda. The plant technology described below and the process parameters are specially directed to the alloy being used here and to the technique of spray-compacting and the structure formation of the liner. Other suitable etching agents would be apparent to those skilled in the art as would suitable devices for accomplishing the etching.

The following process parameters are preferred:

Fluid agent: aqueous 4.5 to 5.5% caustic soda (NaOH),

Treatment temperature: 50±3° C.,

Exposure time: 15 to 50 seconds, preferably about 30 seconds,

Flow rate: 3 to 4 liters per cylinder during the treatment time.

Figure 6:
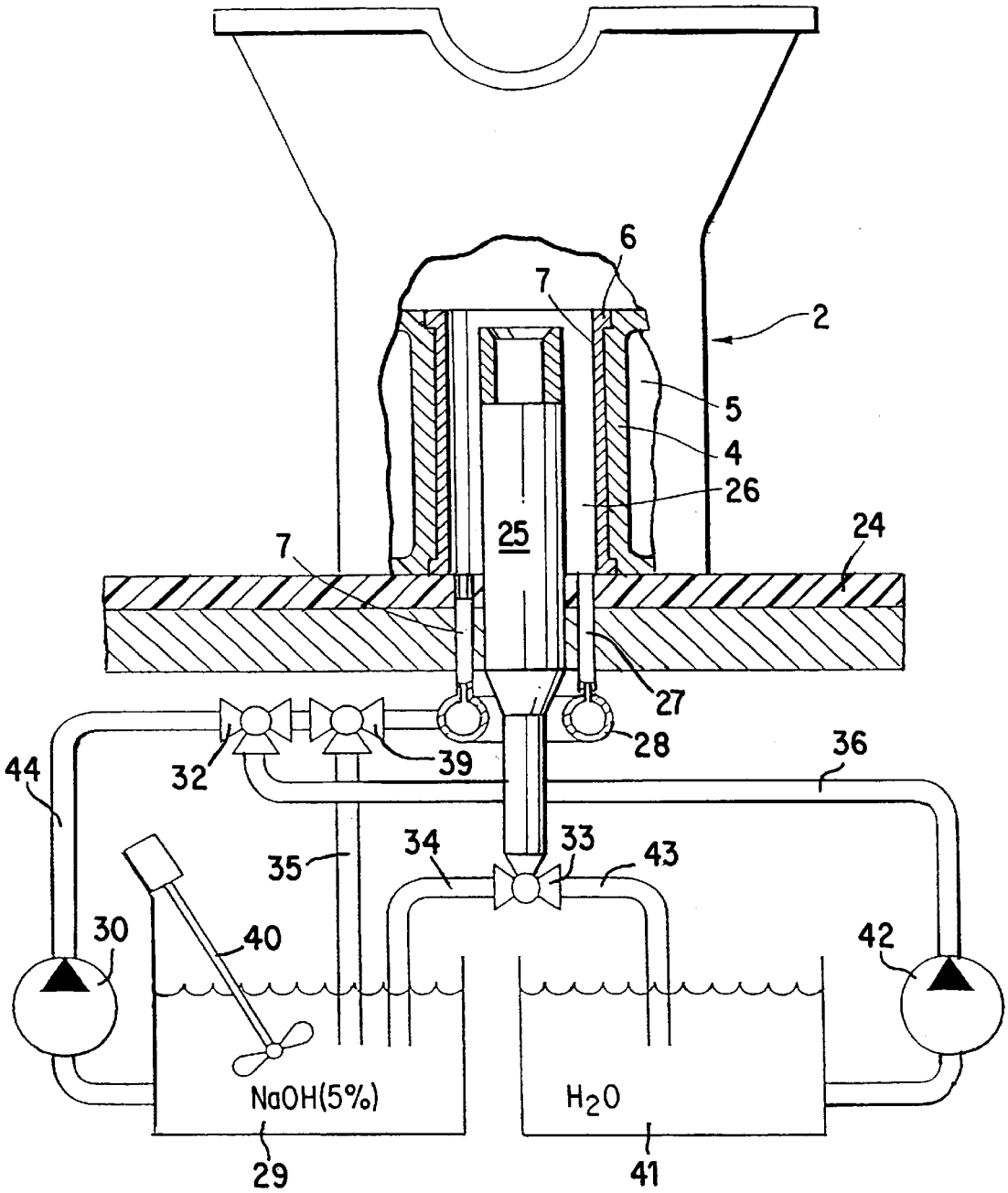
FIG. 6 is an elevational view, partly in cross-section and partly schematic, showing a device for exposing, by means of a fluid, the hard particles from the surface of the cylinder liner.

In conjunction with the chemical exposing, the installation which is to be used here, shown diagrammatically in FIG. 6, is discussed in more detail. The installation has a bench with a gasket 24, to which the crankcase 2 which is to be machined is clamped, making a seal, by its flat side facing the cylinder head. An outflow tube 25 protrudes concentrically from below into the interior of each cylinder liner 6, the outflow tube passing in a sealed manner through the gasket 24. Corresponding to the number and position of the cylinders of a crankcase to be treated, outflow tubes are also provided correspondingly in the treatment bench. Between the running surface 7, to be treated, of the cylinder liner and the outflow tube, an equidistant annular gap 26 which, in operation, is filled with fluid, remains. By its free upper rim functioning as an overflow, the outflow tube ends a little below the cylinder liner end, pointing upwards in the machining position, on the crankshaft side. A plurality of end pieces 27 of a feed line 28 are likewise taken in a sealed manner through the gasket 24 and lead into the said annular gap. In a first collecting vessel 29, a fluid agent serving as etching fluid, for example, about a 5% aqueous caustic soda solution, is held in stock and this can be delivered by means of a first pump 30 via a first delivery line 31 and a first three-way valve 32 into the feed line and hence into the annular gap 26. The fluid agent, overflowing at the top into the outflow tube 31, passes via a second three-way valve 33 and a first return line 34 back into the collecting vessel 29. The return line 34 is laid out in such a way that, with an appropriately positioned second three-way valve 33, the content of the outflow tube can completely drain into the collecting vessel 29 under the action of gravity. To enable the annular gap 26 also to drain by a free gradient into the collecting vessel 29 after the fluid agent pump has been switched off, a drain line 35, which leads into the collecting vessel 29 for fluid agent, is connected to the feed line 36 via a two-way valve 39. By means of a heater, not shown, the fluid agent is brought to a temperature of, for example, about 50° C. By means of an agitator 40, the content of the collecting vessel is continuously mixed and held at a uniform concentration; in addition, local temperature differences are levelled out in this way.

Fluid-functionally parallel to the fluid agent circulation described, an entirely analogously structured circuit for rinsing fluid, for example water, having the following components is provided: collecting vessel 41, second pump 42, second delivery line 36, first three-way valve 32, feed line 28, end pieces 27, annular gap 26, outflow tube 44, second three-way valve 33, second return line 43 and, again, the collecting vessel 41. By means of simultaneous actuation of the two three-way valves, the circuit for fluid agent or the one for rinsing agent can selectively be activated and connected to the treatment section, in particular the annular gaps 26. Before the change-over from fluid agent to rinsing agent, the treatment section, that is to say the workpiece-side part of the circuits beyond the two three-way valves 32 and 33, must first of all be completely drained of fluid agent so that the rinsing agent is not enriched with fluid agent.

To expose the primary Si crystals and particles of intermetallic phase located in the running surface 7, after a crankcase 2 has been firmly clamped to the gasket 28 in the correct position the fluid circuit is first connected by means of the two three-way valves 32 and 33 to the treatment section, in particular the annular gap 26, and the annular gap 26 is then flooded, by means of the fluid agent pump 30, with fluid agent from the collecting vessel 29. Expediently, the crankcases are previously brought to the treatment temperature, that is to say, for example, about 50° C., so that no heat is removed from the fluid agent brought to temperature and the desired treatment temperature also is in fact immediately applied to the running surface 7 which is to be treated. During a defined treatment time of preferably about 30 seconds, the delivery step is maintained at a moderate circulation rate—about 0.1 l/second and per cylinder. The treatment time is empirically selected as a function of the type of fluid agent, the concentration and the temperature in such a way that the desired depth t of exposing is reached within this time.

After the treatment time, the fluid agent pump 30 is stopped and the annular gap is drained of fluid agent into the collecting vessel 29 via the now opened two-way valve 39; at the same time, the outflow tube 44 also drains into the collecting vessel 29 via the three-way valve 32 which is still open towards the vessel 29. After the two-way valve 39 has been closed again, the rinsing agent circuit can be connected to the annular gap 26 by changing over the two three-way valves 32 and 33, and the rinsing agent pump 42 can be switched on. The annular gaps 26 and especially the running surfaces 7 of the crankcase are then rinsed free of fluid agent, for which purpose the rinsing agent circuit remains switched on for a certain, empirically optimized time. Subsequently, the rinsing circuit is stopped again and the content of the outflow tube is drained into the rinsing agent vessel 20 via a free gradient. The annular gap 26 must also be drained, but, in the illustrative embodiment shown, opening the two-way valves 39 causes it to drain via the drain line 35, only into the collecting vessel. After this, the finished crankcase can be released and removed from the installation. The installation is then ready to receive a new workpiece.

Figure 5:
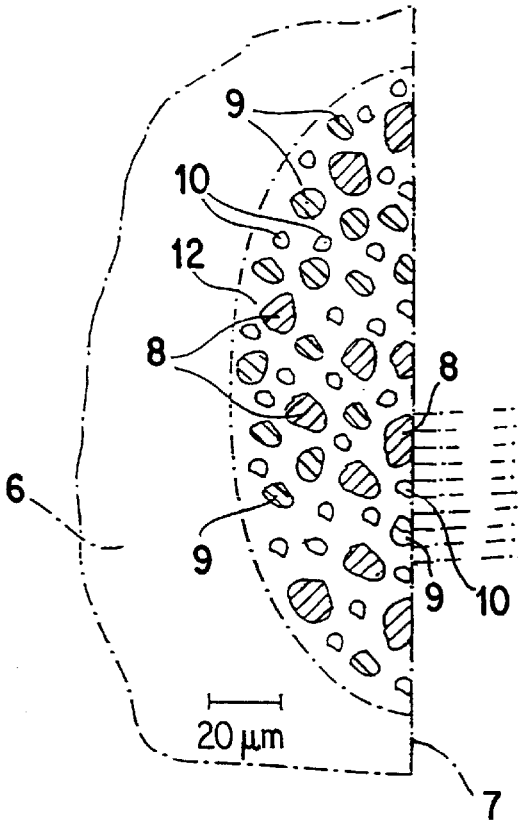
FIG. 5 is a magnified portion of a cross-section of the cylinder liner made by the method of the second embodiment close to the surface, taken parallel to the cylinder wall.
Figure 5A:
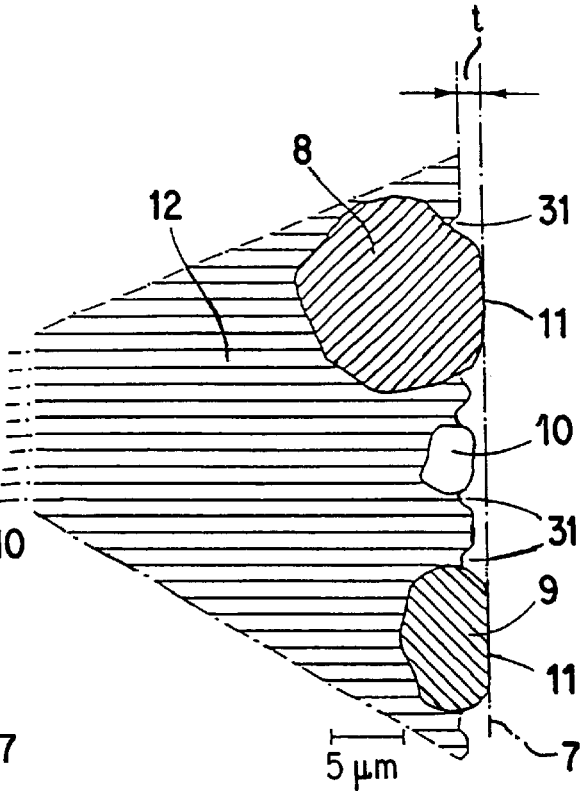
FIG. 5*a* is a further enlargement of FIG. 2.

By means of this type of treatment, a slight amount of the matrix material, located between the individual hard particles present on the surface, is removed, so that the harder particles protrude with a plateau face 11 (FIGS. 5 and 5*a*) from the matrix material 12 by the amount of the depth t of exposing. In the boundary region of the particles, a small depression 31 is formed, the depth of which is, however, so small that nevertheless good mechanical bonding of the particles into the matrix material is achieved. The depth t of exposing is influenced by the process parameters indicated and is controlled accordingly.

The structure formation is adjusted such that, even at very small depths t of exposing of 0.5 μm or less, functionally reliable running surfaces result. For this reason, a depth of exposing of from 0.3 to 1.2 μm, preferably of about 0.7 μm, is the target. After the primary crystals and/or particles have been exposed, the running surface 7 of the cylinder liner 6 has a roughness with the following values:

| | |
|---|---|
| average peak-to-valley height | $R_z$ = 2.0 to 5.0 μm, |
| maximum individual peak-to-valley height | $R_{max}$ = 5 μm, |
| core peak-to-valley height | $R_k$ = 0.5 to 2.5 μm, |
| reduced peak height | $R_{pk}$ = 0.1 to 0.5 μm and |
| reduced groove depth | $R_{vk}$ = 0.3 to 0.8 μm. |

The terms and values $R_z$ and $R_{max}$ are to be understood and determined here in accordance with DIN 4768, sheet 1, and the terms and values $R_k$, $R_{pk}$ and $R_{vk}$ are to be understood and determined in accordance with DIN 4776.

The small depth of exposing of the load-bearing particles located in the running surface of the liner material, the fine-grained character of the liner material, and the material character thereof, lead altogether to very low oil consumption, to high wear resistance and to good sliding properties. Furthermore, owing to the cylinder liner composed and machined according to the invention, the pistons can be provided with an inexpensive coating and fitted with inexpensive rings.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cylinder liner of a hypereutectic aluminum/silicon alloy, (A) said aluminum/silicon alloy being free of hard material particles independent of the alloy and consisting of, in percent by weight:

| | |
|---|---|
| Silicon | 23.0 to 28.0%, |
| Magnesium | 0.80 to 2.0%, |
| Copper | 3.0 to 4.5%, |
| Iron | at most 0.25%, |
| Manganese, nickel and zinc each at most 0.01%, the remainder being aluminum; | |

(B) said cylinder liner containing primary silicon crystals and intermetallic phases having the following grain sizes, the numerical data denoting the mean grain diameter in μm:

Primary Si crystals: 2 to 15 μm,
$Al_2Cu$ phase: 0.1 to 5.0 μm,
$Mg_2Si$ phases: 2.0 to 10.0 μm;

(C) said cylinder liner having a precision-machined running surface, plateau faces of said primary silicon crystals and particles of intermetallic phases embedded in the running surface being exposed.

2. A cylinder liner according to claim 1, which is cast into a reciprocating piston engine.

3. A cylinder liner according to claim 1, wherein said alloy has the following composition:

| | |
|---|---|
| Silicon | about 25%, |
| Magnesium | about 1.2%, |
| Copper | about 3.9%, |
| Iron | at most 0.25%, |

Manganese, nickel and zinc each at most 0.01%, the remainder being aluminum.

4. A cylinder liner according to claim 1, wherein said primary silicon crystals and intermetallic phases have the following grain sizes, the numerical data denoting the mean grain diameter in μm:
Primary Si crystals: 4.0 to 10.0 μm,
$Al_2Cu$ phase: 0.8 to 1.8 μm,
$Mg_2Si$ phases: 2.5 to 4.5 μm.

5. A cylinder liner according to claim 1, wherein the depth (t) of exposing of at least one of the plateau faces of the primary crystals and the particles relative to the surrounding alloy is about 0.3 to 1.2 μm.

6. A cylinder liner according to claim 5, wherein said depth (t) is about 0.7 μm.

7. A cylinder liner according to claim 1, wherein, after the primary crystals and intermetallic phases have been exposed, the running surface of the cylinder liner has a roughness with the following values:

| | |
|---|---|
| average peak-to-valley height | $R_z$ = 2.0 to 5.0 μm, |
| maximum individual peak-to-valley height | $R_{max}$ = 5 μm, |
| core peak-to-valley height | $R_k$ = 0.5 to 2.5 μm, |
| reduced peak height | $R_{pk}$ = 0.1 to 0.5 μm and |
| reduced groove depth | $R_{vk}$ = 0.3 to 0.8 μm. |

8. A cylinder liner according to claim 1, wherein said plateau faces of said primary silicon crystals and particles of intermetallic phases embedded in the surface are exposed by fine-machining, whereby plateau areas of the exposed silicon primary crystals and intermetallic phases have rounded edges with respect to the surface of the base aluminum/silicon alloy.

9. The cylinder liner as claimed in claim 8, wherein the plateau areas have an exposure depth of the primary crystals and intermetallic particles compared to the base of the aluminum/silicon alloy of from about 0.2 to 0.3 μm.

10. The cylinder liner as claimed in claim 8, wherein the exposed primary crystals and intermetallic particles have, after exposure, a roughness of $R_z$ 0.7 to 1.0 μm on their exposed plateau area.

11. A cylinder liner of a hypereutectic aluminum/silicon alloy, (A) said aluminum/silicon alloy being free of hard material particles independent of the alloy and consisting of, in percent by weight:

| | |
|---|---|
| Silicon | 23.0 to 28.0%, |
| Magnesium | 0.80 to 2.0%, |
| Copper | 3.0 to 4.5%, |
| Iron | at most 0.25%, |

Manganese, nickel and zinc each at most 0.01%, the remainder being aluminum;

(B) said cylinder liner containing primary silicon crystals and intermetallic phases having the following grain sizes, the numerical data denoting the mean grain diameter in μm:
Primary Si crystals: 2 to 15 μm,
$Al_2Cu$ phase: 0.1 to 5.0 μm,
$Mg_2Si$ phases: 2.0 to 10.0 μm;

(C) said cylinder liner having a precision-machined running surface, plateau faces of said primary silicon crystals and particles of intermetallic phases embedded in the running surface being exposed, wherein the cylinder is cast into a reciprocating engine.

12. A cylinder liner of a hypereutectic aluminum/silicon alloy, (A) said aluminum/silicon alloy being free of hard material particles independent of the alloy and consisting of, in percent by weight:

| | |
|---|---|
| Silicon | 23.0 to 28.0%, |
| Magnesium | 0.80 to 2.0%, |
| Copper | 3.0 to 4.5%, |
| Iron | at most 0.25%, |

Manganese, nickel and zinc each at most 0.01%, the remainder being aluminum;

(B) said cylinder liner containing primary silicon crystals and intermetallic phases having the following grain sizes, the numerical data denoting the mean grain diameter in μm:
Primary Si crystals: 2 to 15 μm,
$Al_2Cu$ phase: 0.1 to 5.0 μm,
$Mg_2Si$ phases: 2.0 to 10.0 μm;

(C) said cylinder liner having a precision-machined running surface, plateau faces of said primary silicon crystals and particles of intermetallic phases embedded in the running surface being exposed, wherein the depth (t) of at least one of the exposed plateau faces of the primary crystals relative to the surrounding alloy is about 0.3 to 1.2 μm, wherein the cylinder is cast into a reciprocating engine.

13. A cylinder liner of a hypereutectic aluminum/silicon alloy, (A) said aluminum/silicon alloy being free of hard material particles independent of the alloy and consisting of, in percent by weight:

| | |
|---|---|
| Silicon | 23.0 to 28.0%, |
| Magnesium | 0.80 to 2.0%, |

-continued

| | |
|---|---|
| Copper | 3.0 to 4.5%, |
| Iron | at most 0.25%, |

Manganese, nickel and zinc each at most 0.01%, the remainder being aluminum;

(B) said cylinder liner containing primary silicon crystals and intermetallic phases having the following grain sizes, the numerical data denoting the mean grain diameter in $\mu$m:

Primary Si crystals: 2 to 15 $\mu$m, $Al_2Cu$ phase: 0.1 to 5.0 $\mu$m, $Mg_2Si$ phases: 2.0 to 10.0 $\mu$m;

(C) said cylinder liner having a precision-machined running surface, plateau faces of said primary silicon crystals and particles of intermetallic phases embedded in the running surface being exposed, wherein, the running surface of the cylinder liner has a roughness with the following values:

| | |
|---|---|
| average peak-to-valley height | $R_z$ = 2.0 to 5.0 $\mu$m, |
| maximum individual peak-to-valley height | $R_{max}$ = 5 $\mu$m, |
| core peak-to-valley height | $R_k$ = 0.5 to 2.5 $\mu$m, |
| reduced peak height | $R_{pk}$ = 0.1 to 0.5 $\mu$m and |
| reduced groove depth | $R_{vk}$ = 0.3 to 0.8 $\mu$m, |

wherein the cylinder is cast into a reciprocating engine.

* * * * *